US005567044A

United States Patent [19]

Lopez

[11] Patent Number: 5,567,044

[45] Date of Patent: Oct. 22, 1996

[54] SMOOTH HEADLIGHT GLASS, IN PARTICULAR FOR A MOTOR VEHICLE, AND A METHOD OF MANUFACTURING THE REFLECTOR OF SUCH A HEADLIGHT

[75] Inventor: Francois Lopez, Bondy, France

[73] Assignee: Valeo Vision, Bobigny, France

[21] Appl. No.: 311,552

[22] Filed: Sep. 23, 1994

[30] Foreign Application Priority Data

Sep. 24, 1993 [FR] France ..... 93 11403

[51] Int. Cl.[6] ..... F21V 7/10

[52] U.S. Cl. ..... 362/348; 362/61; 362/297; 362/346; 264/2.5

[58] Field of Search ..... 427/163.1, 163.4; 264/1.9, 2.5; 362/61, 297, 346, 348

[56] References Cited

U.S. PATENT DOCUMENTS

| | | | |
|---|---|---|---|
| 1,732,884 | 10/1929 | Foster | 362/297 |
| 2,999,924 | 9/1961 | Mottier et al. | 362/61 |
| 3,511,983 | 5/1970 | Dorman | 362/297 |
| 4,087,682 | 5/1978 | Kolodziej | 362/348 |
| 5,171,082 | 12/1992 | Watanabe | 362/61 |

FOREIGN PATENT DOCUMENTS

| | | | |
|---|---|---|---|
| 0084934 | 8/1983 | European Pat. Off. . | |
| 0986492 | 3/1951 | France | 362/348 |
| 2460442 | 1/1981 | France . | |
| 2536502 | 5/1984 | France . | |
| 435946 | 10/1935 | Germany . | |

*Primary Examiner*—Denise L. Gromada
*Assistant Examiner*—Alan B. Cariaso
*Attorney, Agent, or Firm*—McCormick, Paulding & Huber

[57] ABSTRACT

The headlight comprises a light source, a reflector having a base surface that is selected to form images of the source in a determined distribution in a lighting direction that is axial and horizontal, and a closure glass. According to the invention, the closure glass is essentially free from deflecting stripes and the reflector includes, over at least a portion of its surface, a plurality of zones in which said base surface is replaced by substitution surfaces of outlines defined by projecting a plane array of polygonal zones onto the base surface, the plane array being defined as a function of a predetermined distribution of light flux. The array of zones corresponds to the array that would have been obtained if it had been an array of stripe zones formed on the closure glass, and the differential offset in a horizontal plane between the base surface and each substitution surface corresponds to the profile that the corresponding stripe would have had if it had been formed on the closure glass.

10 Claims, 4 Drawing Sheets

SMOOTH HEADLIGHT GLASS, IN PARTICULAR FOR A MOTOR VEHICLE, AND A METHOD OF MANUFACTURING THE REFLECTOR OF SUCH A HEADLIGHT

FIELD OF THE INVENTION

The invention relates to a headlight, in particular a headlight for a motor vehicle.

It relates in particular to a headlight of the type comprising a light source such as a filament lamp generally not having a cup, a reflector having a surface designed to form a determined distribution of images of the source in a lighting direction that is axial and horizontal, and a closure glass. In a non-limiting example, the surface of the reflector may be defined analytically so as to form images of the source such that all points thereof lie beneath a predetermined cutoff.

BACKGROUND OF THE INVENTION

Documents FR-A-2 536 502 and FR-A-2 536 503 describe headlights of that type, respectively defining a dipped beam and a fog beam essentially by the special shape of the reflector surface.

That type of headlight makes it possible to avoid use not only of a cup or of a masking screen, but also to avoid a glass having high deflecting capability, and it thus provides a beam that is spread with good uniformity, particularly in the vertical direction.

Nevertheless, those headlights, like conventional headlights, have until now required the use of a closure glass that is provided with deflecting zones (such as stripes or half-stripes), in particular to spread the beam in the horizontal direction and to make it more uniform.

Under such circumstances, when the glass is considerably inclined, as may be desirable for styling reasons, it becomes difficult to implement such deflecting zones and their effectiveness decreases with increasing angle of inclination of the closure glass.

OBJECTS AND SUMMARY OF THE INVENTION

One of the objects of the invention is to provide a headlight enabling a standardized light beam to be produced which is made uniform solely by the reflector, so as to make it possible to use a glass that is smooth or that is provided with stripes that are not functional, i.e. that are purely decorative and that have no optical function.

Essentially, to achieve this object, the invention provides for making the stripes directly on the reflector of the headlight, with the stripes being grouped together in zones as a function of the result to be achieved, said zones being defined in the same manner as the zones that are to be found on conventional deflecting headlight glasses.

Patent GB-A-435 945 describes a headlight in which it is possible to omit deflecting stripes on the glass, which headlight is constituted by a stack of horizontal paraboloidal slices; each of the slices in the stack constituting an independent reflector that provides deflection of strictly parabolic type.

The present invention provides a headlight, in particular for a motor vehicle, the headlight comprising:

a light source;

a reflector having a base surface that is suitable for forming a determined distribution of images of the source in a lighting direction that is axial and horizontal; and a closure glass, wherein:

the closure glass is essentially free of deflecting stripes; and the reflector includes, over at least a portion of its surface, a plurality of zones in which said base surface is replaced by superimposition surfaces of outline defined by projecting a plane array of polygonal, and in particular rectangular, zones along said axial direction onto the base surface, the array being defined as a function of a predetermined distribution of light flux, said array of zones corresponding to the array that would have been obtained had it been an array of striped zones formed on the closure glass, and the differential offset in a horizontal plane between the base surface and the superimposition surface corresponding to the profile that said corresponding stripe would have had if it had been formed on the closure glass.

The invention also provides a method of manufacturing a reflector for a headlight, in particular for a motor vehicle, the reflector being suitable for forming images of the source in a determined distribution, and the projector including a closure glass that is essentially free of deflecting stripes, the method comprising the following steps:

defining a base reflecting surface for the reflector so as to form images of the source in a base distribution in a lighting direction that is axial and horizontal;

replacing a plurality of zones of said base reflecting surface, over at least a portion thereof, with superimposition surfaces, the outlines of said superimposition surfaces being defined by projecting a plane array of polygonal, and in particular rectangular, zones onto the base surface along said axial direction, the array being defined as a function of a predetermined distribution of light flux, said array of zones corresponding to the array that would have been obtained if an array of stripe zones had been formed on the closure glass, and by selecting a differential offset in a horizontal plane between the base surface and the superimposition surface, which offset corresponds to the profile that the corresponding stripe would have had if it had been formed on the closure glass;

making a mold for the reflector by machining as a function of data defining the base surface and the superimposition surfaces; and molding the reflector using said mold.

The invention applies most advantageously to a reflecting surface that is analytically defined in such a manner as to form images of the source with all of the points thereof being situated beneath a predetermined cutoff.

As appropriate, the superimposition surfaces may be such that two adjacent substitution surfaces are connected together either without any gap along their common edge, or else via a step along their common edge.

According to another preferred aspect of the invention, over at least a major portion of the reflector, the superimposition surfaces are contiguous surfaces that connect to one another continuously in the horizontal direction along their common edges.

BRIEF DESCRIPTION OF THE DRAWINGS

Other characteristics and advantages of the invention appear on reading the following detailed description given with reference to the accompanying drawings.

MORE DETAILED DESCRIPTION

Figure 1:
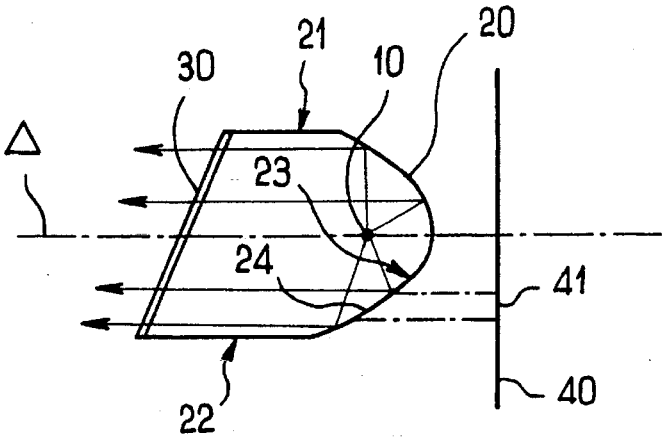
FIG. 1 is a diagrammatic section view through a headlight of the invention.
Figure 2:
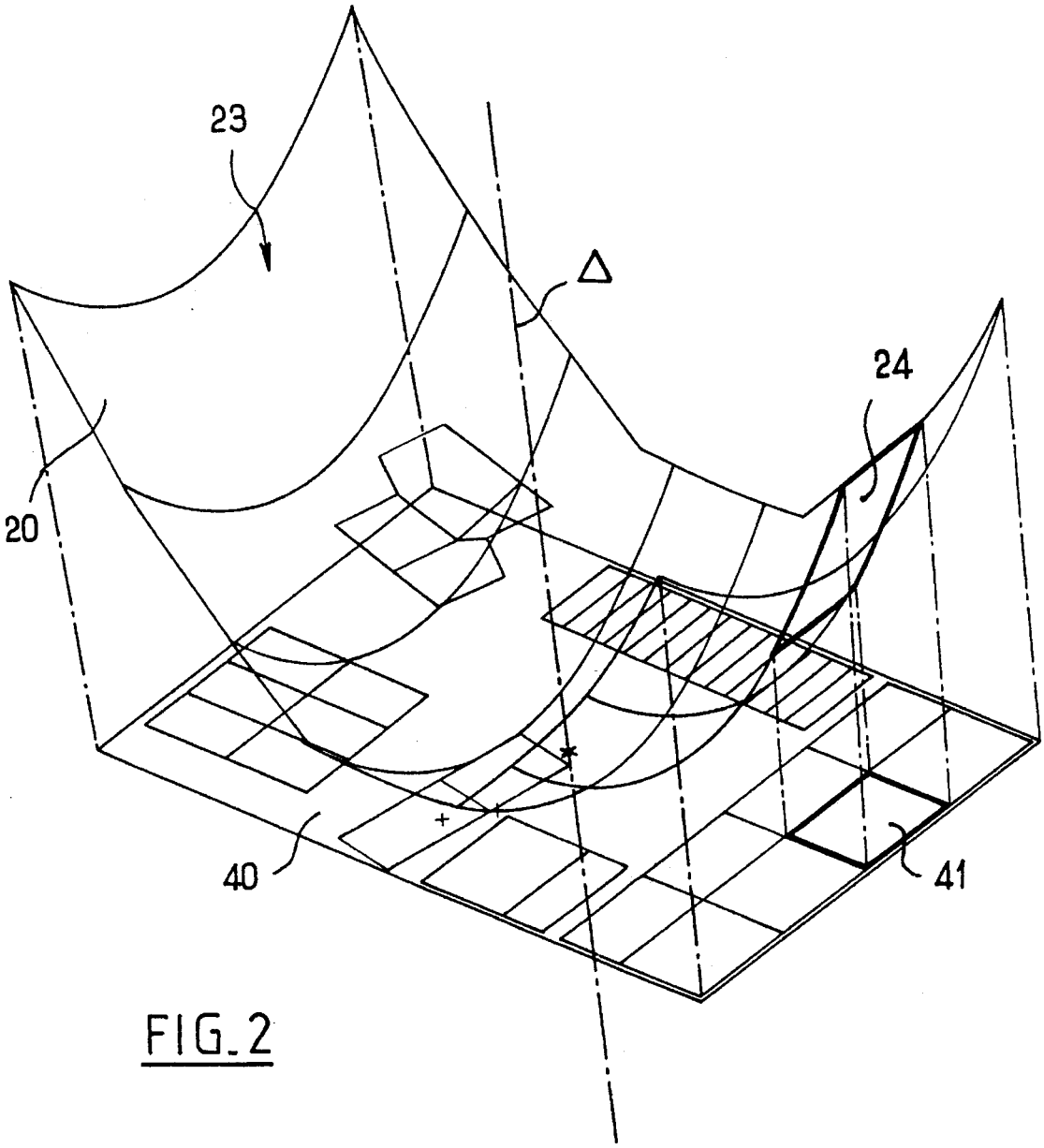
FIG. 2 shows the way in which the stripe zones are distributed over the surface of the reflector as a function a plane definition of an array of deflecting zones.

FIG. 1 is highly diagrammatic, showing a motor vehicle headlight that comprises a light source 10, in particular a filament lamp, a reflector or mirror 20 of the above-specified type having an analytically defined surface, and optionally truncated by two half-planes 21 and 22, and a closure glass 30. The light source 10 does not include any cup or masking screen, with the cutoff being defined solely by the shape of the reflector 20. The assembly produces a light beam directed forwards from the vehicle in a lighting direction Δ that is axial and horizontal.

It may be observed that the filament can be replaced by the arc of a discharge lamp.

In a manner characteristic of the invention, the closure glass 30 is essentially smooth or is provided with stripes that are decorative only, having no optical function, with the beam being spread out and made uniform in the horizontal direction solely by the reflector 20.

To this end, an array of stripe zones is defined in a plane 40 that is perpendicular to the lighting direction Δ as a function of the desired light distribution of the beam to be generated by the headlight, in exactly the same way as would have been used for defining such an array of stripe zones on a conventional deflecting closure glass extending perpendicularly to the lighting direction Δ.

Figure 3:
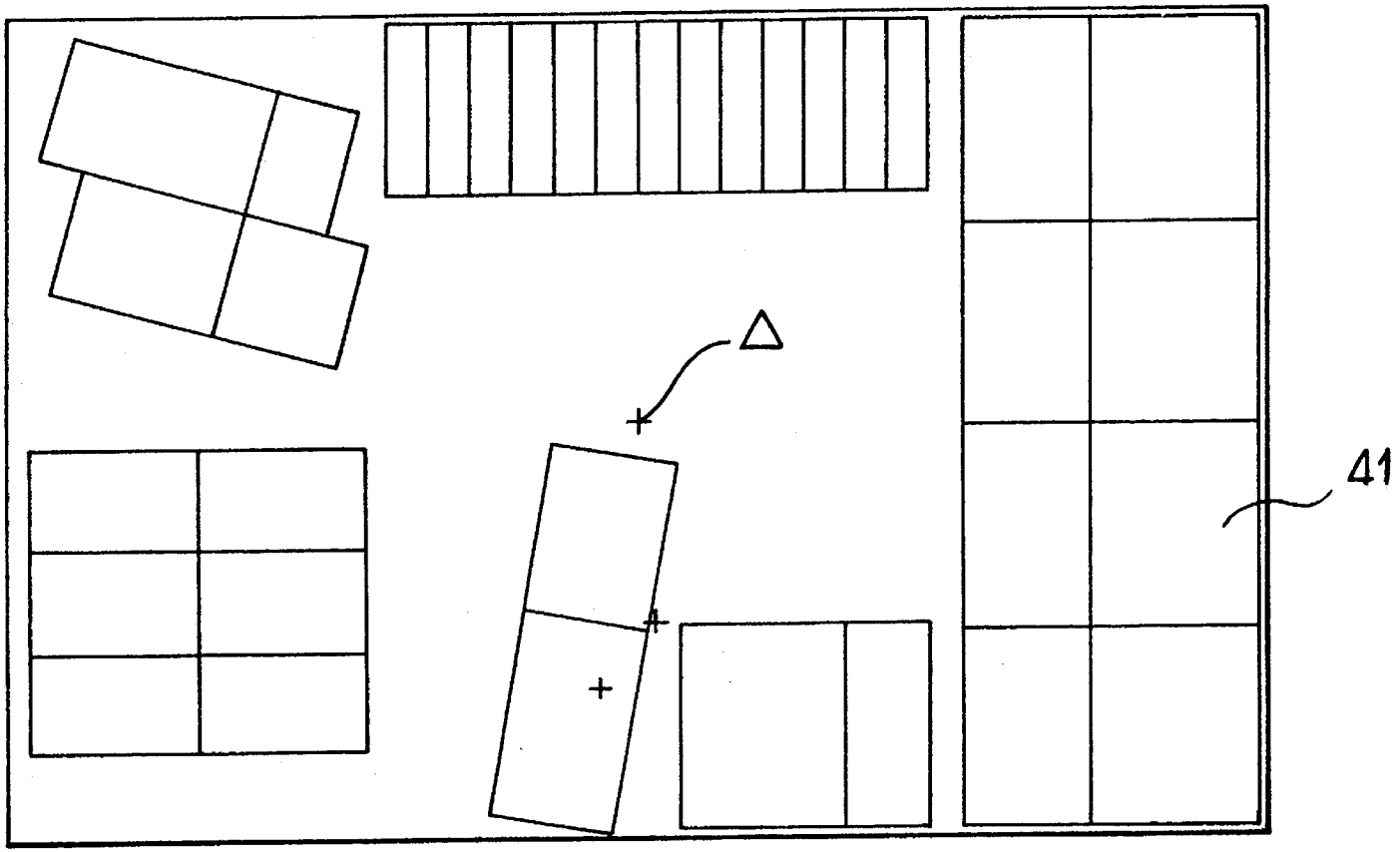
FIG. 3 is a front view of the plane array of deflecting zones shown in FIG. 2.

The front view of FIG. 3 shows an array of deflecting zones corresponding to a first embodiment of the invention suitable for a left headlight mirror. These deflecting zones are referenced 41 and each of them may be contiguous or non-contiguous with other, adjacent zones.

Each of the zones 41 is then projected along Δ onto the surface 23 of the reflector 20, such that the lighting direction Δ also constitutes the projection direction for this purpose. This has the effect of defining, for each zone 41, a corresponding zone 24 of curvilinear outline on the reflector (the zones 41 are themselves polygonal in outline), and a stripe-forming superimposition surface is formed at the location of each reflector zone 24, said superimposition surface 24 being defined relative to the projection surface 23 (i.e. the analytically-defined surface) by a differential offset δ in a horizontal plane and corresponding to the profile that the corresponding stripe would have had if it had been formed on a closure glass.

Figure 4:
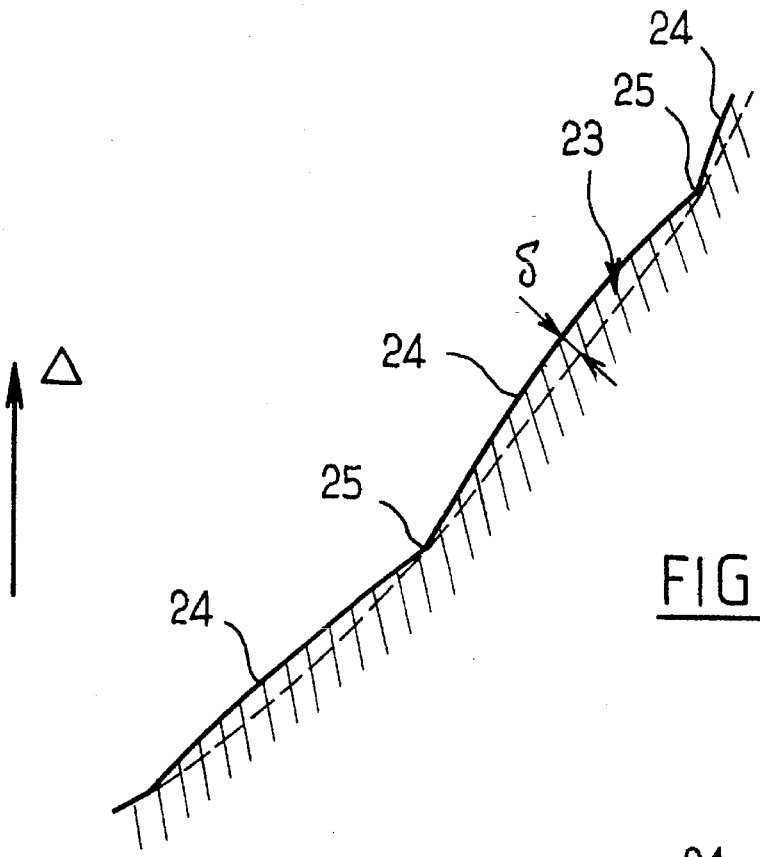
FIG. 4 is a fragmentary horizontal section through the surface of a first embodiment of the reflector of FIGS. 1 and 2.

The profile of the stripe can be seen, in particular, in FIG. 4 where the slightly curved shape exhibits a differential offset δ of 0.1 mm to 0.5 mm in the direction normal to the projection surface 23. A greater offset could nevertheless be used if it is desired to impart a prismatic effect to the stripes.

Figure 5:
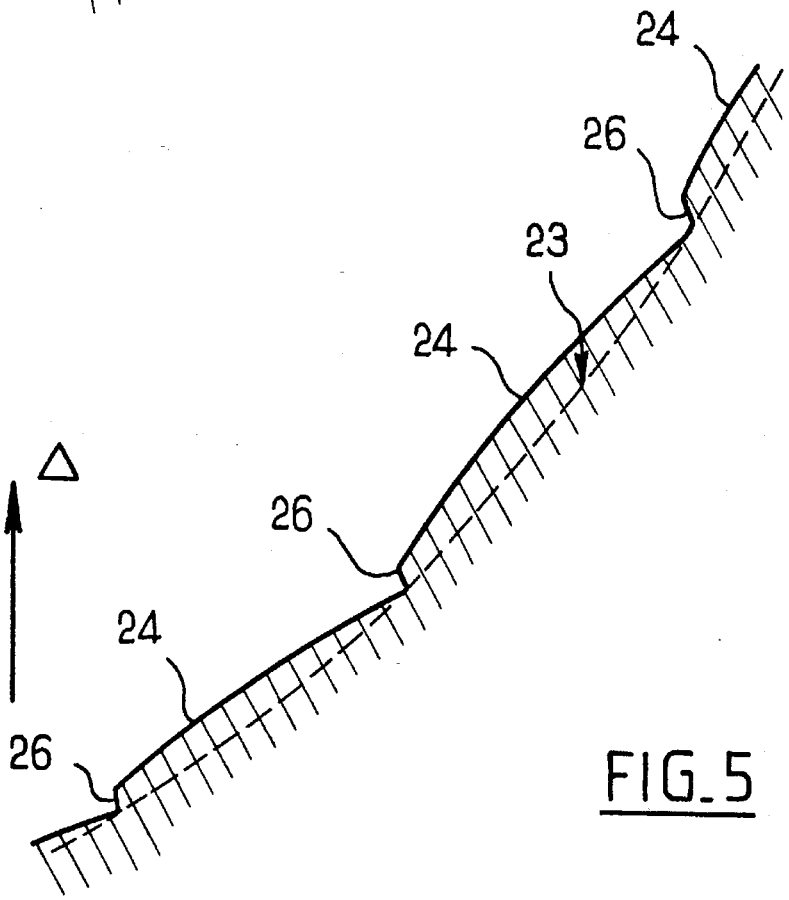
FIG. 5 is similar to FIG. 4, but for a variant embodiment of the invention.

FIG. 4 shows complete stripes, i.e. adjacent surfaces 24 connect together without any gaps along their common edges 25. In a variant, instead of having complete stripes, it is possible to provide half-stripes, likewise oriented in an essentially vertical direction, but connected to one another via steps 26, as shown in FIG. 5, which steps do not impede proper operation given the essentially vertical orientation of the half-stripes. Any possible defects due to the discontinuities to which the steps give rise merely result in the corresponding light rays being deflected laterally.

Figure 6:
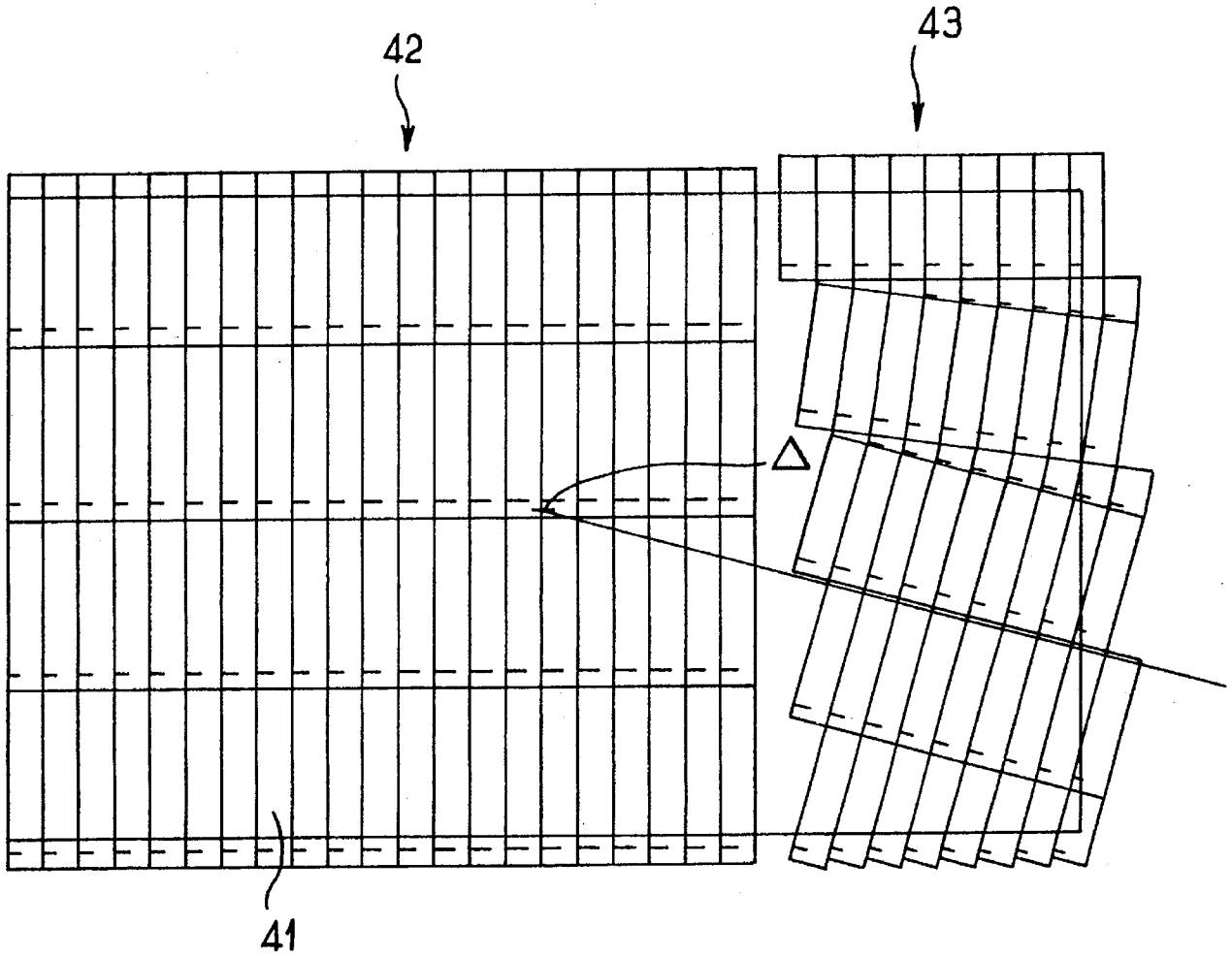
FIG. 6 is similar to FIG. 3, but for a second embodiment.

In a second embodiment, shown in FIG. 6 (and corresponding to a right headlight), "varying" stripes are used, i.e. the profile of each stripe varies continuously along its length, with the various zones 41 over the major portion of the reflector being contiguous areas that connect to one another continuously in the horizontal direction along their common edges.

In the first embodiment, the discontinuities that result from the horizontal transition zones produce, in the light pattern, horizontal lines that can be dazzling, and which are also amplified if it is necessary to coat the mirror with a protective varnish since the varnish tends to be deposited non-uniformly and to concentrate in more or less unforeseeable manner around the discontinuities. This difficulty can be mitigated by using varying stripes.

I claim:

1. A headlight, in particular for a motor vehicle, the headlight comprising:

a light source;

a reflector having a base surface such that a determined distribution of images of the source is formed in a lighting direction that is axial and horizontal; and a closure glass that is essentially free of light distribution stripes;

the reflector including, over at least a portion of said base surface, a plurality of zones in which light-spreading stripe surfaces are superimposed onto said base surface, each of said zones having an outline and said outlines being defined by projecting a plane array of polygonal, and in particular rectangular, zones along said axial direction onto said base surface, said array being defined as a function of a predetermined distribution of light flux and corresponding to a notional array of striped zones on said closure glass that would have generated the same light distribution, and a differential offset in a horizontal plane between the base surface and each light-spreading stripe surface corresponding to a profile of a respective notional zone of said notional array on said closure glass.

2. A headlight according to claim 1, wherein said base surface of the reflector is a surface that is analytically defined so as to generate images of the source all points of which lie below a predetermined cutoff.

3. A headlight according to claim 1, wherein said light-spreading stripe surfaces are such that two adjacent stripe surfaces connect together without a gap along their common edge.

4. A headlight according to claim 1, wherein said light-spreading stripe surfaces are such that two adjacent stripe surfaces connect together via a step along their common edge.

5. A headlight according to claim 1, wherein over at least a major portion of the reflector, the light-spreading stripe surfaces are contiguous surfaces that are connected to one another continuously in the horizontal direction along their common edges.

6. A method of manufacturing a reflector for a headlight, in particular for a motor vehicle, the headlight including a source, a reflector and a closure glass that is essentially free of light distribution stripes, the reflector being such that a determined distribution of images of the source is formed, the method comprising the following steps:

defining a base reflecting surface for the reflector so as to form images of the source in a base distribution in a lighting direction that is axial and horizontal;

superimposing a plurality of zones of said base reflecting surface, over at least a portion thereof, with respective light-spreading stripe surfaces, each of said zones having an outline and said outlines being defined by projecting a plane array of polygonal, and in particular rectangular, zones along said axial direction onto the base surface, the array being defined as a function of a predetermined distribution of light flux and corresponding to a notional array of striped zones on said closure glass that would have generated the same light distribution if an array of stripe zones had been formed on the closure glass, and selecting a differential offset in a horizontal plane between the base surface and each light-spreading stripe surface corresponding to a profile of a respective notional zone of said notional array on said closure glass;

machining a mold for molding the reflector as a function of data defining the base reflecting surface and the light-spreading stripe surfaces; and molding the reflector using the mold.

7. A method according to claim 6, wherein the base reflecting surface of the reflector is a surface that is analytically defined so as to generate images of the source all points of which lie below a predetermined cutoff.

8. A method according to claim 6, wherein the light-spreading stride surfaces are such that two adjacent stride surfaces connect together without a gap along their common edge.

9. A method according to claim 6, wherein the light-spreading stripe surfaces are such that two adjacent stride surfaces connect together via a step along their common edge.

10. A method according to claim 6, wherein over at least a major portion of the reflector, the light spreading stripe surfaces are contiguous surfaces that are connected to one another continuously in the horizontal direction along their common edges.

* * * * *

UNITED STATES PATENT AND TRADEMARK OFFICE

CERTIFICATE OF CORRECTION

PATENT NO. : 5,567,044

DATED : October 22, 1996

INVENTOR(S) : Francois Lopez

It is certified that error appears in the above-indentified patent and that said Letters Patent is hereby corrected as shown below:

Claim 8, Column 6:

Line 10, delete the first and second occurrence of the word "stride" and substitute --stripe--.

Claim 9, Column 6:

Line 14, delete the word "stride" and substitute --stripe--.

Signed and Sealed this

Seventh Day of January, 1997

*Attest:*

*Attesting Officer*

BRUCE LEHMAN

*Commissioner of Patents and Trademarks*